US009581155B2

(12) United States Patent
Hibbard

(10) Patent No.: US 9,581,155 B2
(45) Date of Patent: Feb. 28, 2017

(54) SELF-PRIMING POSITIVE DISPLACEMENT CONSTANT FLOW HIGH CAPACITY PUMP

(76) Inventors: Richard Hibbard, Canyon Lake, CA (US); Billye Lou Hibbard, legal representative, Canyon Lake, CA (US)

( * ) Notice: Subject to any disclaimer, the term of this patent is extended or adjusted under 35 U.S.C. 154(b) by 1353 days.

(21) Appl. No.: 10/963,071

(22) Filed: Oct. 12, 2004

(65) Prior Publication Data

US 2006/0083638 A1 Apr. 20, 2006

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/12*** | (2006.01) |
| ***F04C 2/08*** | (2006.01) |
| ***F04C 15/00*** | (2006.01) |

(52) U.S. Cl.

CPC ..... *F04C 2/123* (2013.01); *F04C 2/08* (2013.01); *F04C 2/084* (2013.01); *F04C 15/0019* (2013.01); *F04C 15/0042* (2013.01); *F05C 2225/00* (2013.01); *F05C 2225/02* (2013.01)

(58) Field of Classification Search

CPC .. F04C 2/08; F04C 2/082; F04C 2/084; F04C 15/0019; F04C 15/0026; F04C 15/0076; F04C 2/123; F01C 21/108; F05C 2225/00; F05C 2225/04; F05C 2225/02

USPC ..... 418/206.1–206.6, 126, 189, 190, 132, 418/152, 178, 179

See application file for complete search history.

(56) References Cited

U.S. PATENT DOCUMENTS

| | | | | | |
|---|---|---|---|---|---|
| 114,156 | A | * | 4/1871 | Laidlaw | 418/206.5 |
| 263,196 | A | * | 8/1882 | Morse | 418/206.5 |
| 294,026 | A | * | 2/1884 | Pitts | 418/206.1 |
| 295,597 | A | * | 3/1884 | Troutman | 418/206.5 |
| 2,262,231 | A | * | 11/1941 | Guibert et al. | 418/206.5 |
| 2,262,321 | A | * | 11/1941 | Gundlfinger et al. | 178/79 |
| 2,463,080 | A | * | 3/1949 | Beier | 418/206.6 |
| 2,491,677 | A | * | 12/1949 | McCulloch | 418/206.6 |
| 3,043,230 | A | * | 7/1962 | Molly | 418/131 |
| 3,050,011 | A | * | 8/1962 | Karl et al. | 418/206.5 |
| 3,130,682 | A | * | 4/1964 | Meads | 418/206.5 |
| 3,392,676 | A | * | 7/1968 | Bizier | 418/206.5 |
| 3,986,800 | A | * | 10/1976 | Dworak et al. | 418/126 |
| 4,057,375 | A | * | 11/1977 | Nachtrieb | 418/206.1 |
| 4,564,346 | A | * | 1/1986 | Kimmons et al. | 418/206.5 |
| 5,108,275 | A | * | 4/1992 | Sager | 418/206.5 |

(Continued)

FOREIGN PATENT DOCUMENTS

| | | | | | |
|---|---|---|---|---|---|
| GB | 2170863 | A | * | 8/1986 | 418/206.5 |
| JP | 05288177 | A | * | 11/1993 | 418/206.5 |

*Primary Examiner* — Theresa Trieu

(57) ABSTRACT

A rotary action, self-priming positive displacement constant flow high capacity fluid pump is described. None of the pump parts touch in the pump chamber to minimize pump wear allowing for extended pump life. Since there are no touching parts in the pump chamber, the pump can be operated dry without the pump liquid being present without damage to the pump. The pump may be operated either clockwise or counter-clockwise without loss of positive displacement or reduction in fluids input or output. Due to the design of the pump, the pump is inherently low-maintenance and is highly resistant to clogging by debris and the like. Fluid pressure relief sections are provided by carving out of the inside portions of the housing structure to which the ends of the shaft are mounted to vary or improved pump performance.

2 Claims, 7 Drawing Sheets

(56) References Cited

U.S. PATENT DOCUMENTS

| | | | | | |
|---|---|---|---|---|---|
| 5,320,508 | A | * | 6/1994 | Kiefer | 418/206.5 |
| 5,895,210 | A | * | 4/1999 | Nakaniwa et al. | 418/206.5 |
| 6,164,945 | A | * | 12/2000 | Ishibashi et al. | 418/206.5 |

* cited by examiner

SELF-PRIMING POSITIVE DISPLACEMENT CONSTANT FLOW HIGH CAPACITY PUMP

BACKGROUND OF THE INVENTION

1. Field of the Invention

This invention relates to pumps, and, more particularly, to liquid pumps of the rotary, positive displacement, and self priming pumps capable of being operated by hand or by the application of a source of rotary power such as a fuel-driven engine or an electrical motor.

2. Description of the Prior Art

The present pump is an improvement over a previously patented pump, U.S. Pat. No. 4,057,375 issued to Nachtrieb on Nov. 8, 1977 and which expired on Nov. 8, 1994.

In the prior art, positive displacement pumps and centrifugal pumps are used in moving fluids, typically liquids, from one location to another.

The centrifugal pump bases it pumping action by vortexually swirling the liquid to be pumped at relatively high speeds, and, thereafterwards, allowing the the liquid to pass through a ported chamber. Such pumps are noted for their simplicity and relatively long operational life expectancies. Nevertheless, a centrifugal pump is also noted for [it's] its pump inefficiency, has only a small lift capacity, and produces only moderate head pressure. As a result, centrifugal pumps are usually arranged in staggered, serial stages in order to produce the desired high head pressures. But, such multi-staged centrifugal pumps are expensive, relatively complex in design, and are usually less efficient than a single stage centrifugal pump.

The pump in Nachtrieb is also a rotary-type fluid pump. However, the prior art pump of Nachtrieb is limited to functioning as a semi-positive displacement, and is not self priming as is the present invention described hereinafterwards. Additionally, the instant invention is self-priming. Another major difference lies in the design of the vane structures. In the pump design of Nachtrieb, the vane structures are limited to using vanes which are rectangular in shape and are straight in the cross-sectional view thereof. In the improved pump disclosed herein, the key elements have been improved upon in that the vanes do not have flat faces, but are contoured instead, and the new and improved pump is self-priming. Additionally, the various fluid pressure relief sections carved out of the housing structure; namely, the inlet/outlet pressure release chambers, the side pressure release chambers, the center compression release channels, and the side compression release channels are modified to vary or improve pump performance which result in a semi-positive displacement pump which is not self-priming.

SUMMARY OF THE INVENTION AND OBJECTS

Fundamentally, there is described and disclosed herein a new and improved rotary action, self-priming, positive displacement, constant flow high capacity fluid pump. None of the pump parts contact the housing which contains the pump chamber to minimize pump wear and allow for extended pump life. Since there are no non-flexible moving parts which contact the housing which contains the pump chamber, the pump can be operated dry without the pump liquid being present and without incurring any damage to the pump. Additionally, the pump may be operated either in a clockwise or counter-clockwise rotational direction without loss of positive displacement or reduction in fluids input or output. Due to the design of the pump, the pump is inherently low-maintenance and is highly resistant to clogging by debris and the like. Various fluid pressure relief sections are provided by carving out inside portions of the housing structure to create the inlet/outlet pressure release chambers, the side pressure release chambers, the center compression release channels, and the side compression release channels to vary or improve pump performance.

Most applications of this improved unique rotary pump, often referred to as a "positive displacement pump" result in significant savings of energy, such as electricity, fuel, and/or physical exertion.

Harnessing Geo-Thermal Power to Generate Electricity

For example, geo-thermal sources of power, particularly the deep hot located in various parts of the world, such as in the Imperial Valley of Southern California in North America, offer enormous potential for the harnessing and use of this otherwise unused geo-thermal energy source. Modernly, attempts are currently underway to utilize this hot water resource to generate economical and practical amounts of electrical energy. However, there exists one very difficult problem to be solved before such efforts can become more practical and economically successful. Due to the large quantities of mineral salts present in such waters, turbines and centrifugal pumps currently being utilized are subject to build-up of layers of encrustations of mineral salts and scale which render such machinery inoperable after a relatively short period of operation.

To overcome this problem, in regards to turbines, the steam which results from exposing the hot water (350° degrees Fahrenheit) to the open atmosphere is not fed directly to the turbines but is used to heat a Rankin Cycle system which employs iso-butane gas to directly drive such turbines. Such a closed system is complicated and very costly. Practically speaking, a more direct and simplified method is clearly needed. An additional problem is that the condensed steam must be pumped back into the ground, presently accomplished by the use of high pressure multi-stage centrifugal pumps, which quickly become operationally clogged with mineral deposits. In the present invention, however, the pump incorporates a self-cleaning action, and, as such, offers a real solution to the mineralization and salination problem. As a result, through the use of the instant positive displacement pump, it is practical now to generate potentially vast amounts of electrical power at extremely lost cost per kilowatt/hour and, at the same time, incurs only minimal maintenance, time and expense and requires the use of only and a comparatively small amount of machinery.

Agricultural Industry Applications

The agricultural industry uses enormous quantities of small gasoline engines for driving small high speed centrifugal pumps to spray liquid fertilizers and insecticides onto the crop fields. Unfortunately, such pumps must be operated at high speed (3,425 RPM and higher) to develop the required pressure for useful operation of the centrifugal pumps. This high speed greatly shortens the useful life of such small engines. Additionally, due to the speed of the gasoline engines, fuel consumption and air pollution are high at such rotational velocities. The use of the unique and improved positive displacement pump described herein, when adapted for use in such applications, may be functionally operational at one-fifth (⅕) of the speed of the present equipment [resulting in] greatly extending the life of the engine life and significantly reducing fuel consumption.

The total energy usage and expense for the operation of all types of agricultural irrigation equipment is enormous. The vast majority of such pumping is accomplished by the use of centrifugal pumps ranging in size from tiny fractional horsepower ones to much larger electrical prime fluid movers. The present improved positive displacement pump disclosed herein could easily replace such widely used pumping equipment and could theoretically save as much as fifty (50%) percent of the energy presently being used in such operations.

There are more than one million privately-owned swimming pools in the United States of America, virtually all of which use electrically-powered centrifugal pumps to circulate water for filtration and heating purposes. For example, if the savings in energy costs amounted to $75.00 per month per pool, by replacing the existing energy-guzzling electrically-powered centrifugal pumps with the new and improved pump disclosed herein, a savings of $75,000,000.00 or more could be realized.

Use of the Positive Displacement Pumps on Fire Trucks

Standard models of fire trucks deliver 1,200 gallons per minute of water at 150 psi static pressure and utilize diesel engines which develop as high as 300 horsepower. Such pumpers cost in excess of $75,000.00 each and are seldom used at full capacity. There is a definite need for lower cost equipment with similar pumping capacity and for pumpers capable of delivering three (3) times the volume of water at the present cost of standard pumpers. The present invention described herein, when specifically designed for this purpose, could meet both needs. Although such applications have little to do with energy savings, property protection and the lowering of fire insurance rates would make the initial cost of doing so economically practical. It is clear that when the instant positive displacement pump operated in this fashion could be of significant value in areas where manual power alone is available to move water, or other fluids, since it amplifies a human's normal capability to move water over such more primitive methods (such as carrying buckets) by at least a factor of eighteen or more.

Surpasses Capabilities of Centrifugal Pumps

The present invention surpasses the capabilities of centrifugal pumps not only as an energy saver, but because of the following attributes: it operates at a much lower speed thereby increasing the operating life of the pump's bearings and seals, pumps liquid of almost any kind or type, can operate as high as 40,000 SSU viscosity, has an extremely low shear factor, the delivery rate of flow can be metered, is self-priming, there is only a small loss in efficiency relative to the increase in pressure and/or head and lift, it has an extremely broad performance range, and may be powered by virtually any type of rotary power source.

Further, it can be operated in a manner almost identical to that of a gear or vane type pumps, but with a flowrate equivalent to that of centrifugal pumps, and this positive displacement pump can effectively perform in a multitude of applications ordinarily requiring the use of centrifugal pumps of special design.

It is one important and primary object of the instant invention to provide a rotary pump configuration wherein the contoured vanes result in a greater positive displacement of the fluids and pressure.

Another important object of the present invention is to provide a rotary pump which is significantly more efficient due to the reduced loss of fluid volume as the fluid head pressure increases.

It is yet a still further and primary object of the invention to provide a rotary pump configuration which creates a self-priming ability which was not previously available in high volume rotary pumps.

Another important and significant feature of this unique invention is to provide a rotary pump configuration in which the configuration of the rotary vanes or impellers can be readily modified to meet the desired requirements of the pumping application.

It is one primary and important feature of the present invention to provide a unique rotary pump design of the bottom chamber to eliminate compression of fluids while allowing rapid fluid flow through the pump while operating in either direction without loss of positive displacement or reduction in the input or output of the fluids.

Another important feature of the instant invention is to provide a new interlocking device between the rotary shaft and the rotary impellers/vanes to insured positive locking therebetween.

An additional feature and modification of the present invention is that a flexible neoprene tip can be added to the extremities of the rotary vanes or impellers to increase the positive displacement of the rotary pump.

It is yet a still further improvement and characteristic of this new and improved rotary pump to provide lobe contoured impellers or vanes incorporating involute shapes and the outer extremities of the impeller blades.

DETAILED DESCRIPTION OF THE PREFERRED EMBODIMENT OF THE INVENTION

Figure 2:
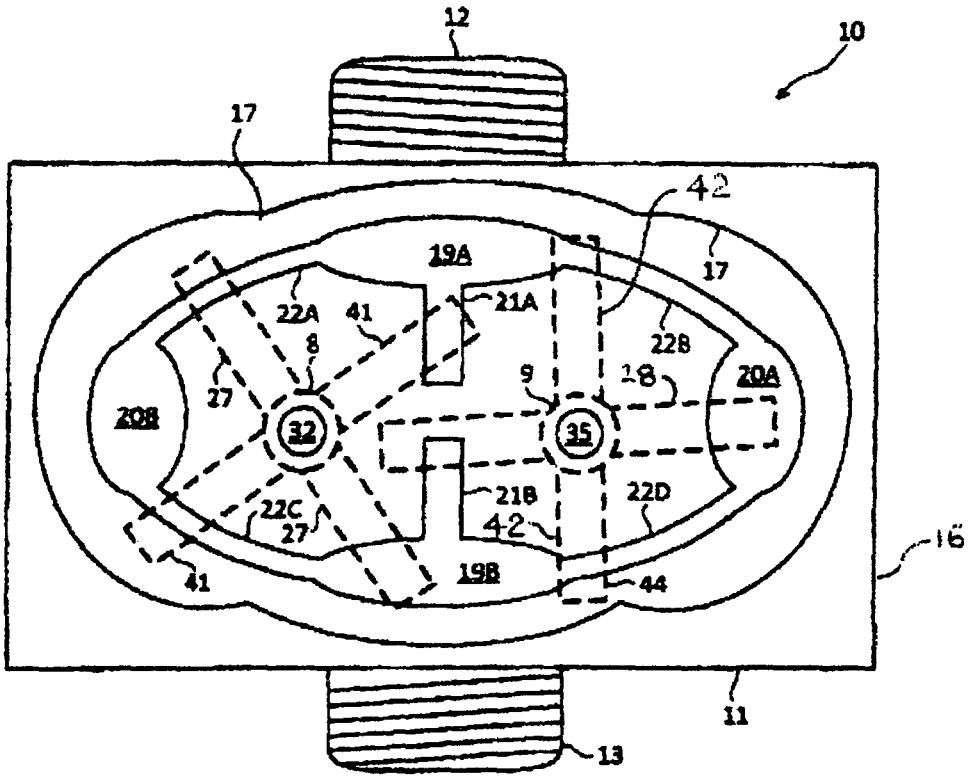
FIG. 2 is a diagrammatic view of the present invention showing both the exterior pump housing and the interior pump chamber, along with the input/output ports, the inlet/outlet pressure release chambers, the side pressure release chambers, the center compression release channels, and side compression release channels.
Figure 3:
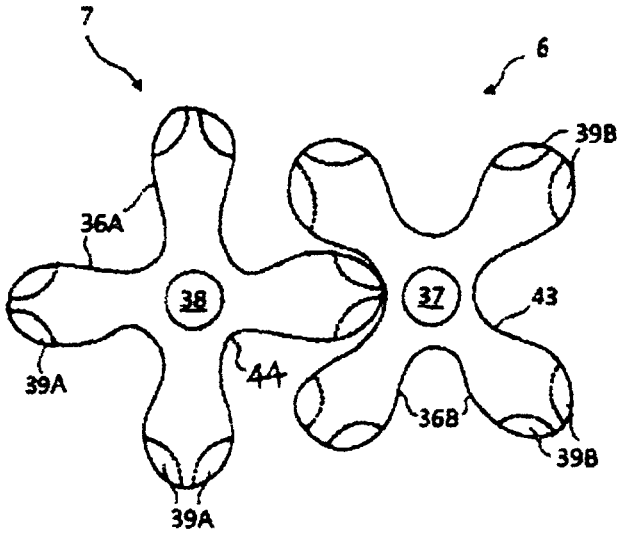
FIG. 3 is a view of the two (2) impellers or vanes of the present invention shown intermeshing one with the other.
Figure 5:
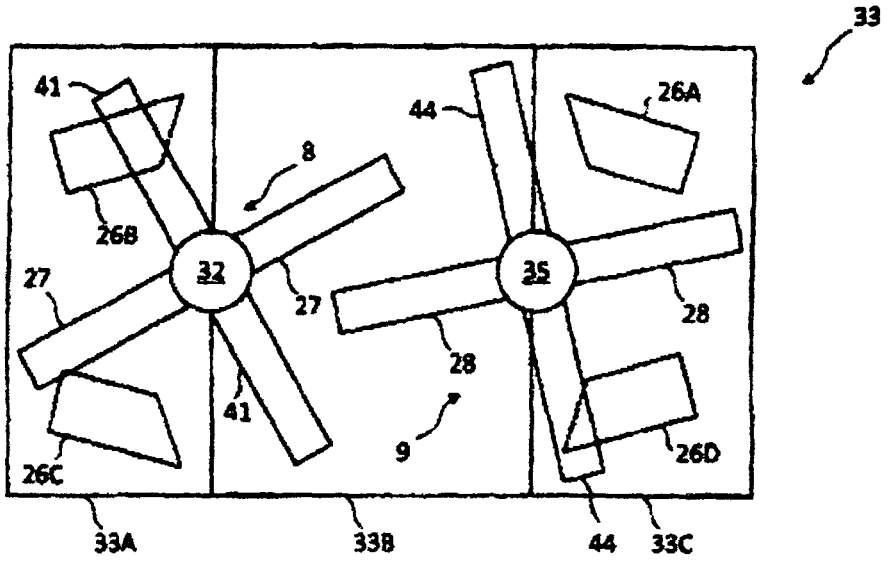
FIG. 5 is a top view of the bottom plate with relief cavities of the stationary pump housing.
Figure 8:
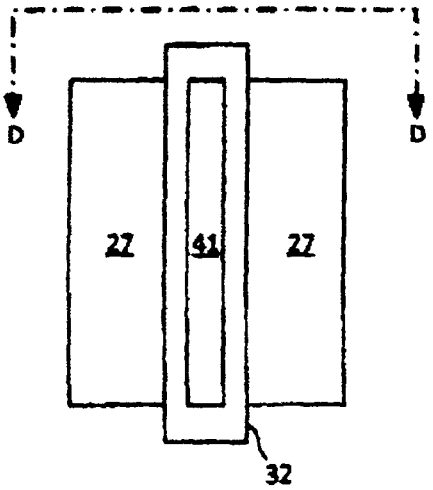
FIG. 8 is a side elevational view of the first impeller.
Figure 9:
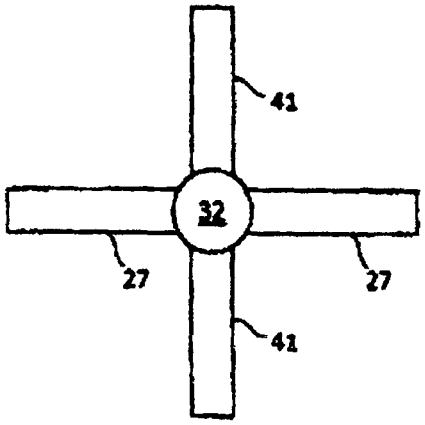
FIG. 9 is an end view of the first impeller taken along Plane D-D of FIG. 8 of the Drawings herein.
Figure 7:
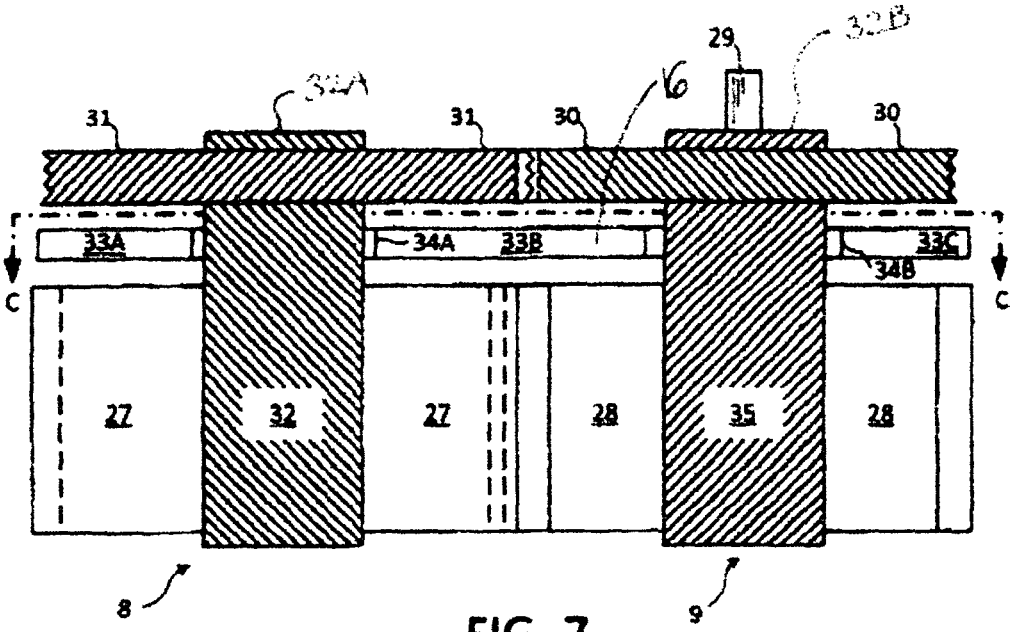
FIG. 7 is a side elevational view of the combination shown and illustrated in FIG. 6

With continuing reference to all of the Drawings herein, and with primary reference to FIG. 2 FIG. 3 and FIG. 7, there is basically shown and described a new and useful positive displacement, self-priming, reduced speed, high volume fluid pump, comprising a pump housing 11 having an interior pump chamber 17 with at least one open entrance 16 thereinto, a pair of fluid inlet/outlet ports 12 and 13 in the pump housing 11 in fluid communication with the interior pump chamber 17, a pair of impellers 8, 9 each having a shaft 32, 35 for rotatably mounting each impeller 8, 9 and each impeller 8, 9 respectively having a plurality of vanes 27, 41 and 28, 42 extending respectively from each shaft 32, 35, and adapted for operative synchronistic rotatable non-contacting disposition between the plurality of vanes 27, 41 and 28, 42 within the pump chamber 17, at least one element adapted to be mounted to the pump housing 11 about the open entrance into the pump housing 11 and having means thereon for rotatably mounting the ends of the of the shafts 32, 35 therein, and on one side of the vanes 27, 41 and 28, 42 are a pair of side pressure release chambers 20A, 20B, a pair of center compression release channels 21A, 21B, a complementary pair of center pressure release chambers 19A, 19B, a plurality of side compression release channels 22A, 22B, 22C and 22D, and disposed in the pump chamber 17 on the other side of vanes 27, 41 and 28, 42 as shown in FIG. 5 are fluid pressure relief sections 26 A, 26 B, 26 C and 26 D.

The primary differences between the present invention and the prior art invention of which Nachtrieb is believed to be the closest prior art reference is not only the use of re-designed, more efficient newer vane structures than those used in the prior art pump design disclosed and described by Nachtrieb where the rotary pump vanes of the impellers are flat-faced, are rectangular in shape and have a flat front face and corresponding flat backside, but primarily in the incorporation of a complementary pair of side pressure release chambers 20A, 20B, complementary center compression release channels 21A, 21B in fluid communication respectively with a corresponding complementary pair of center pressure release chambers 19 A, 19 B and a plurality of side compression release channels 22A, 22B, 22C and 22D which chambers 19A, 19B are fluidly interconnected with the side pressure release chambers 20 A, 20 B, and, on the other side of the vanes 27, 41 and 28, 42 are disposed in the pump chamber 17 as shown in FIG. 5 fluid pressure relief sections 26 A, 26 B, 26 C and 26 D.

Figure 10:
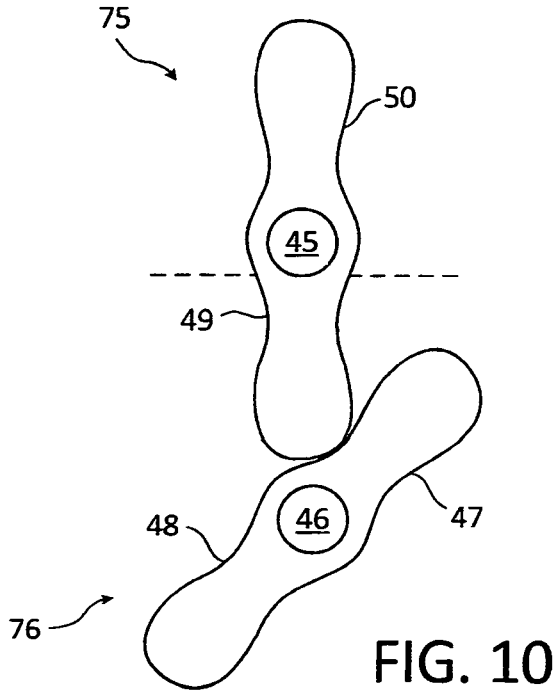
FIG. 10 shows an internal fluid pump implementation of the present invention utilizing a pair of dual impellers with contoured blades.
Figure 11:
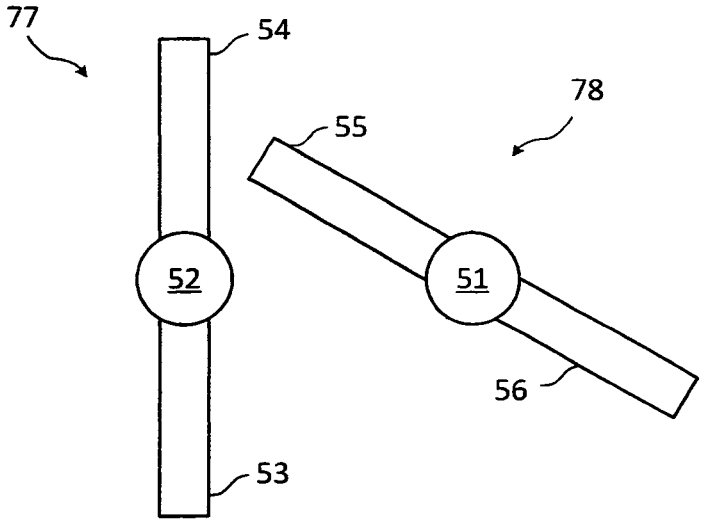
FIG. 11 illustrates an internal fluid pump implementation of the instant invention disclosed herein utilizing a pair of dual impellers with flat blades.
Figure 12:
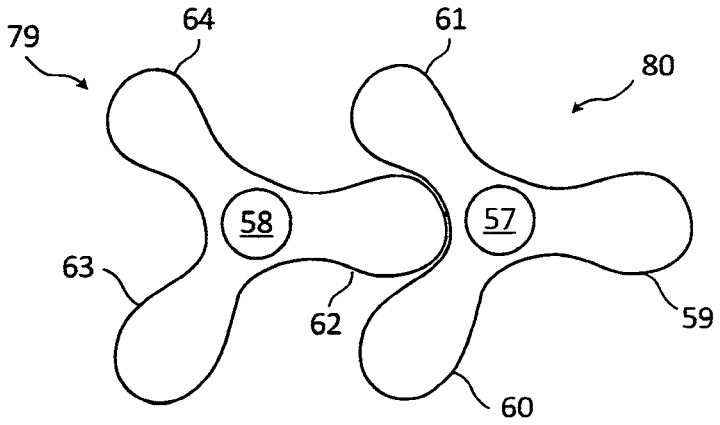
FIG. 12 depicts an internal fluid pump implementation of the invention described herein utilizing a pair of three impellers each having contoured blades.

In the present invention, however, not only can flat faced vanes be used, such as depicted in FIGS. 2, 5, 8, 9, 11 and 13, but vanes can be employed which are not flat-faced, but are contoured instead, such as shown in FIGS. 3, 10 and 12 whereby they do not have flat surfaces on the front or backside portions of the vanes of the impellers of the rotary pump.

Along with the important and significant modification of the impeller vanes 27, 28, fluid pressure relief sections 26 A, 26 B, 26 C and 26 D are incorporated in under the pump housing 11 structure near the ends of the shaft of the rotating pump impellers. These fluid pressure relief sections 26 A, 26 B, 26 C and 26 D which are carved out of the inside portion of the stationary pump housing 11 can be adjusted in size and volume to vary or improve pump performance at various rotational speeds to adjust the operation of the pump to pump fluids having varying amounts of particulate matter in the fluid.

Figure 1A:
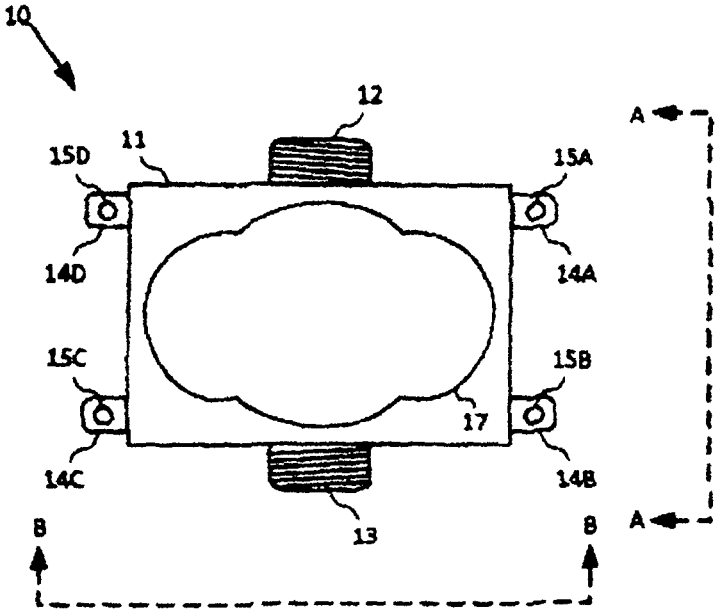
FIG. 1A is a drawing of the stationary portion of the rotary pump housing showing the top view thereof.
Figure 1B:
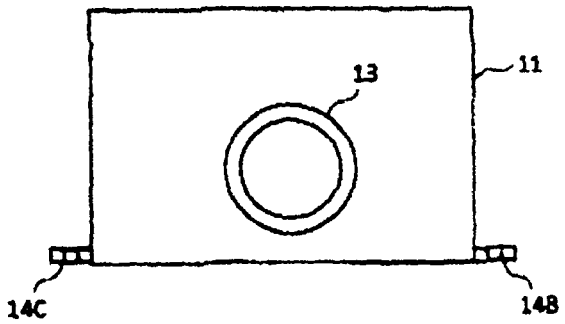
FIG. 1B is a drawing of the stationary portion of the rotary pump housing showing the front view taken along Plane B-B of FIG. 1A and the back view thereof.
Figure 1C:
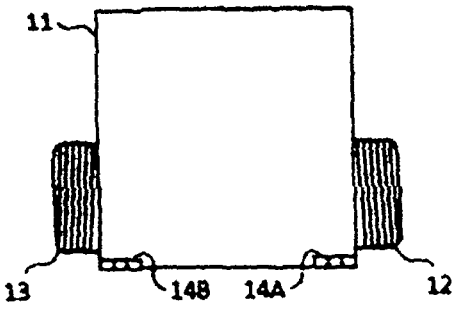
FIG. 1C is a drawing of the stationary portion of the rotary pump housing showing the side view thereof taken along Plane A-A of FIG. 1A.

Fundamentally, there is described and disclosed herein a new and improved rotary action, self-priming, positive displacement, constant flow high capacity fluid pump generally indicated at 10 in the various figures showing in diagrammatic form in FIGS. 1A, 1B, and 1C. The rotary pump casing or housing is indicated generally at 11 In FIGS. 1A, 1B, and 1C. FIG. 1A is a top view of the rotary pump casing 11, FIG. 1B is a back or rear view of the rotary pump casing 11, and FIG. 1C is a side elevational view of the rotary pump housing 11.

As noted in these figures, as part of the pump housing 11, there is a first inlet/outlet 12 and a second inlet/outlet 13.

It should be clearly understood that the first inlet/outlet 12 and a second inlet/outlet 13 are designated as an inlet/outlet because each of these outlets, the first outlet 12 and the second outlet 13, can be used as either a fluid inlet or fluid outlet in the following manner. If the first inlet/outlet 12 is used as an inlet, then the second inlet/outlet 13 will be used as an outlet. If the second inlet/outlet is used as an inlet 13, then the first inlet/outlet 12 will be used as an outlet.

As noted and shown in FIGS. 1A, 1B, and 1C, mounting lugs 14A, 14B, 14C and 14D secured to the rotary pump housing 11 to any suitable mounting surface (not shown) to stabilize the entire pump housing 11 during operation of the rotary pump 10. Attachment of the mounting lugs 14A, 14B, 14C and 14D to the mounting surface is accomplished by screws, bolts or other suitable fasteners via the holes 15A, 15B, 15C and 15D in the corresponding lugs 14A, 14B, 14C and 14D.

With special reference now to FIG. 2, there is shown and illustrated the interior portion of the pump housing 11. As noted and shown, there is an open entrance 16 to the pump housing 11, with an [interior] pump chamber 17, inlet/outlet ports 12, 13, the inlet/outlet pressure release chambers 19A, 19B, the side pressure release chambers 20A, 20B, the center compression release channels 21A, 21B, and the side compression release channels 22A, 22B, 22C, and 22D.

The above combination of pressure release chambers 19 A, 19 B, 20 A, and 20 B, the compression release channels 21 A, 21 B, 22 A, 22 B, 22 C and 22 D all combine to create a greater efficiency due to a reduced loss of volume as head pressure increases. Additionally, this configuration and combination creates a self-priming capability not available in high volume pumps of a different pump design.

This design configuration of the pump chamber 17 eliminates compression of fluids while allowing rapid flow of the fluids through the pump 10 while, at the same time, operating in either direction without loss of positive displacement or reduction in the fluids' input or output. In short, this pump 10 can be operated in either direction; that is, the inlet/outlet ports 12, 13 can be switched to operate as either an inlet port or an outlet port. For example, if port 12 is fluidly connected as an inlet port, then port 13 will be the fluid outlet port, and visa versa.

Figure 6:
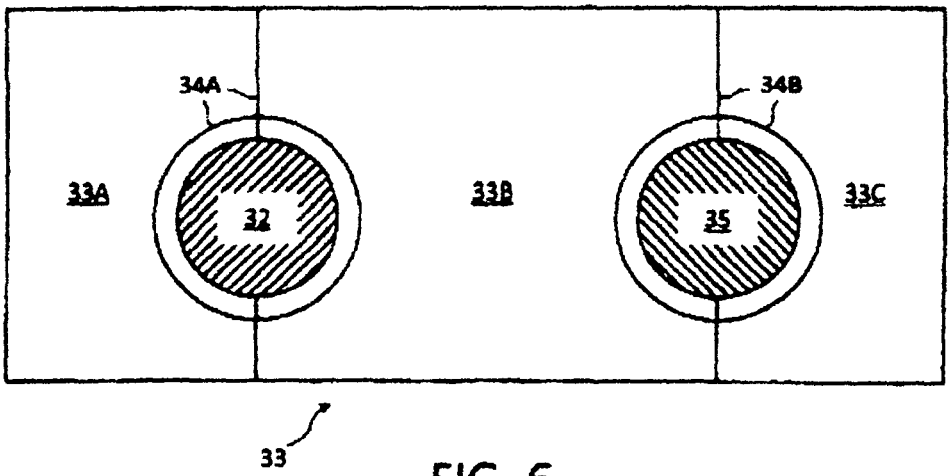
FIG. 6 is a top view of the three separator plates, in an alternative embodiment of the present invention showing the special fluid seals about the two pump shafts and disposed inbetween the gear housing and the rotary pump housing taken along Plane C-C of FIG. 7.

Turning now to FIG. 5 and FIG. 6, there is shown, in generally diagrammatic form, the gear and impeller separator plate assembly and fluid closure plate assembly 33 removably secured about opening 16 in pump housing 11, and a plurality of fluid pressure relief cavities 26A, 26B, 26C and 26D.

With respect to the illustrations in FIGS. 6 and 7, there is shown, from a top view, the two impellers 27 and 28, driven by a driving shaft 29, through intermeshing gears 30, 31 connected to the shafts 32, 35 on which the impellers 27, 28 are rotatably mounted wherein the gears 30, 31 mesh with each other and synchronize rotation of the first and second rotary impellers 8, 9 (FIG. 2) to ensure that the vanes 27, 41 and 28, 42 do not contact one another during rotation. A gear and impeller separator plate generally indicated at 33, is formed of three (3) separate plates, 33A, 33B, and 33C which secured to the pump housing 11 completes enclosure of open entrance 16 of the fluid chamber 17 inside the pump housing 11.

As shown in FIGS. 6 and 7, fluid seals 34A and 34B are provided for sealing between the plates 33A, 33B and 33C and about the shafts 32, 34.

The impellers 42, 43 are shown each with four (4) vanes 36A and 36B. Shafts 37, 38 are provided for mounting the impellers 43, 42 respectively on the shafts 37, 38.

Figure 4:
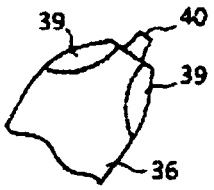
FIG. 4 illustrates the use of a Neoprene tip mounted on the extremity of the impellers or vanes to increase the efficiency of the pump by effectuating a seal between the stationary pump housing and the impellers or vanes.

With specific emphasis now on FIG. 3, there is shown and illustrated the preferred impellers generally indicated at 42 and 43. Cut-out slots 39 are provided in each of the extremities of the vanes 36A, 36B for clearance between the intermeshing extremities of the vanes between each of the tips of the vanes 36A, 36B as the impellers 43, 44 intermeshing rotate in synchronism with the vanes 36 A, As noted and illustrated in FIG. 4, there is shown a Neoprene tip seal 40 for the purpose of enhancing the dynamic fluid sealing function between the extremity of the tip of the impeller blade 36 and the fluid chamber 17 of the pump housing 11.

It should be clearly understood and noted that the number of blades on the impellers can be increased for improved performance. The performance characteristics are improved over the current design shown and illustrated in these drawings based upon sealing produced by the involute design of the impeller hub and the outer extremities of impeller blades.

It should be noted from the beginning that none of the pump parts touch in the pump chamber. The primary purpose of this non-contacting feature is to minimize pump wear, allowing for extended pump life, and boosting the self-priming feature of this unique fluid pump.

Also, since there are no parts which touch each other in the pump chamber, the pump can be operated dry without the pump liquid being present and without incurring any damage to the pump.

Additionally, the pump may be operated either clockwise or counter-clockwise without loss of positive displacement or reduction in fluids input or output. Due to the design of the pump, the pump is inherently low-maintenance and is highly resistant to clogging by debris and the like.

The fluid pressure relief sections are provided by carving out of the inside portions of the housing structure to which the ends of the shaft are mounted to vary or improve pump performance.

In FIG. 10, there is illustrated a pair of dual-vaned impellers generally indicated at 75 and 76 each of which is adapted for operable rotatable disposition inside the housing of a fluid pump of the type and character described previously, each impeller 75 and 76 respectively having, a pair of contoured vanes 49, 50 and 47, 48. Impeller 75 is mounted on a rotatable shaft 45 and impeller 76 is mounted on a rotatable shaft 46.

FIG. 11 depicts a pair of dual-vaned impellers generally shown at 77 and 78 each of which is adapted for operable rotatable disposition inside the housing of a fluid pump of the character and type described previously herein, each impeller 77 and 78 having a pair of flat-faced vanes 53, 54 and 55, 56. Impeller 77 is mounted to a rotatable shaft 52 and impeller 78 is mounted to a rotatable shaft 51.

Turning now to FIG. 12, there is additionally shown and illustrated a pair of triple-vaned impellers 79 and 80 each of which is adapted for operable rotatable disposition inside the housing of a fluid pump of the nature and character described hereinbefore. Each impeller 79 and 80 respectively having three contoured vanes 62, 63, 64 and vanes 59, 60, 61. Impeller 79 is mounted to a rotatable shaft 58 and impeller 80 is mounted to a rotatable shaft 57.

Figure 13:
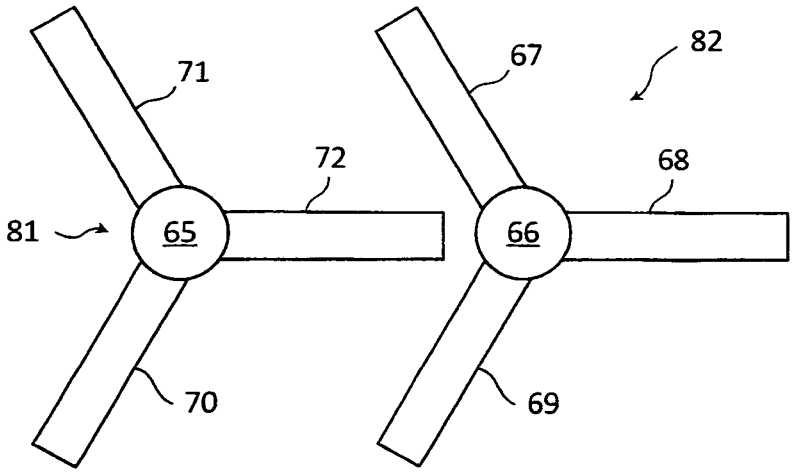
FIG. 13 describes an internal fluid pump of the inventive character disclosed herein incorporating the use of a pair of three impellers each with flat blades.

There is illustrated and shown in FIG. 13 a pair of triple-vaned impellers generally indicated at 81 and 82 each of which is operatively adapted for rotatable disposition inside the housing of a fluid pump of the character and type described previously herein, each impeller 81 and 82 respectively having flat-faced triple-vanes. mounted to a rotatable shaft. Impeller 81 is mounted to rotatable shaft 65 and impeller 82 is mounted to rotatable shaft 66.

The utilization of flat-faced vanes for an impeller provides for pumping a greater amount of fluid per rotation due to their greater volumetric efficiency over an impeller with contoured faced vanes.

Contoured faced vanes provide a fluid pressure gradient to exist across the face of a vane with a contour which is especially useful in pumping fluids of different viscosities. With the contoured vanes shown in FIGS. 3, 10 and 12 illustrated as having bulbous outer extremities, the weight of such contoured vanes provides for smoother impeller rotation due to rotational momentum developed due to the extra weight at the outer extremity of each such vane.

Although the present invention has been described in accordance with the embodiments shown, one of ordinary skill in the art will recognized that there could be variations to the embodiment and those variations would be within the spirit and scope of the present invention. Therefore, although the present invention was described in terms of a particular manner and verification system, one of ordinary skill in the art would readily recognize, that any number of parameters can be utilized and their use would be within the spirit and scope of the present invention. Accordingly, many modifications may be made by one of ordinary skill without departing from the spirit and scope of the present invention, the scope of which is defined and limited only by the following claims.

What is claimed is:

1. An improved rotary, self-priming, constant flow, high capacity, positive displacement pump for pumping fluids, comprising:

a pump housing having a fluid inlet and a fluid outlet;

a first rotary impeller operably disposed in the pump housing, comprising a shaft including shaft ends rotatably mounted in the pump housing, the shaft including a plurality of vanes having contoured faces extending outwardly therefrom;

a second rotary impeller operably disposed in the pump housing, comprising a shaft including shaft ends rotatably mounted in the pump housing, the shaft including a plurality of vanes having contoured faces extending outwardly therefrom;

a pair of gears each secured to at least one of the ends of the shafts of the first and second rotary impellers, wherein the gears mesh with each other and synchronize rotation of the first and second rotary impellers to ensure that the vanes do not contact one another during rotation; and a first side pressure release chamber disposed inside the pump chamber in the pump housing, the first side pressure release chamber operationally disposed at the sides of the vanes of the first impeller, wherein each vane has an end, and a flexible seal is secured to the end of each vane.

2. An improved rotary, self-priming, constant flow, high capacity, positive displacement pump for pumping fluids, comprising:

a pump housing having a fluid inlet and a fluid outlet;

a first rotary impeller operably disposed in the pump housing, comprising a shaft including shaft ends rotatably mounted in the pump housing, the shaft including a plurality of vanes having contoured faces extending outwardly therefrom;

a second rotary impeller operably disposed in the pump housing, comprising a shaft including shaft ends rotatably mounted in the pump housing the shaft including a plurality of vanes having contoured faces extending outwardly therefrom;

a pair of gears each secured to at least one of the ends of the shafts of the first and second rotary impellers, wherein the gears mesh with each other and synchronize rotation of the first and second rotary impellers to ensure the vanes do not contact one another during rotation; and a first side pressure release chamber disposed inside the pump chamber in the pump housing, the first side pressure release chamber operationally disposed at the sides of the vanes of the first impeller, wherein each vane has a complementary cut-out slot for clearance during rotation of the impellers during synchronous intermeshing of the vanes.

* * * * *